US006048073A

United States Patent [19]

Shiao

[11] Patent Number: 6,048,073

[45] Date of Patent: Apr. 11, 2000

[54] TELESCOPIC HAND TOOL

[76] Inventor: Hsuan-Sen Shiao, No. 15-1, Lane 369, Min-Chuan Rd., Taichung City, Taiwan

[21] Appl. No.: 09/299,138

[22] Filed: Apr. 23, 1999

[51] Int. Cl.[7] ..... B25B 23/18

[52] U.S. Cl. ..... 362/120; 362/119; 294/65.5; 81/451

[58] Field of Search ..... 362/109, 119, 362/120, 253; 294/65.5; 81/451

[56] References Cited

U.S. PATENT DOCUMENTS

| | | | |
|---|---|---|---|
| 5,647,623 | 7/1997 | Shiao | 294/65.5 |
| 5,878,637 | 3/1999 | Liu | 81/451 |
| 5,913,596 | 6/1999 | Lin | 362/120 |

*Primary Examiner*—Stephen Husar

*Attorney, Agent, or Firm*—Baker & Daniels

[57] ABSTRACT

A telescopic hand tool includes a hollow drive shaft that extends from a handle member and that has a distal bit-retaining end portion. A telescopic shaft is disposed within the drive shaft, and has a distal end section retractable into and extendible outwardly from the distal bit-retaining end portion of the drive shaft. A connecting member is mounted securely on the distal end section of the telescopic shaft so as to be retractable therewith into the drive shaft. The connecting member includes a tubular body having an external screw thread and an end face formed with a receiving hole, and a magnet disposed securely in the receiving hole. A tool accessory has a coupling portion formed with a cavity for capping on the connecting member. The cavity is confined by an internally threaded surrounding wall for connecting threadedly with the external screw thread of the connecting member.

5 Claims, 4 Drawing Sheets

TELESCOPIC HAND TOOL

FIELD OF THE INVENTION

The invention relates to a telescopic hand tool, more particularly to a multi-function telescopic hand tool with a replaceable tool accessory for performing a number of functions and which includes a connecting member that is connected securely and releasably to the tool accessory.

BACKGROUND OF THE INVENTION

FIG. 1 illustrates a conventional telescopic handle tool according to U.S. Pat. No. 5,878,637 and which includes a hollow handle member 10, a hollow drive shaft 12, a telescopic shaft 14 and a tool bit 13.

As illustrated, the handle member 10 is formed with a drive shaft retaining hole 11. The drive shaft 12 has a rear end mounted securely in the retaining hole 11 of the handle member 10, and a front end that confines a bit-retaining hole 120. The telescopic shaft 14 is disposed within the drive shaft 12, and has a distal end portion provided with a magnet 15 such that the telescopic shaft 14 is extendible outwardly of the bit-retaining hole 120 of the drive shaft 12. The bit 13 can be mounted removably in the bit-retaining hole 120 when the telescopic shaft 14 is retracted into the drive shaft 12.

As best shown in FIG. 2, when retrieving a workpiece, such as a screw 16, from a narrow hole, the tool bit 13 can be uprooted from the bit-retaining hole 120. Due to magnetic attraction between the magnet 15 and the tool bit 13, the distal end portion of the telescopic shaft 14 is also pulled outwardly of the drive shaft 12. Upon removal of the tool bit 13 from the telescopic shaft 14, the distal end portion of the telescopic shaft 14 can be inserted into the narrow hole so that the screw 16 can be attracted to the magnet 15 for removal from the narrow hole.

It is desirable to modify the aforesaid conventional telescopic tool so as to increase the functionality of the same to result in added convenience when in use.

In co-pending U.S. patent application Ser. No. 09/121,885, which was filed on Jul. 24, 1998, the applicant disclosed a telescopic hand tool which includes a telescopic shaft, a connecting block, a tool accessory and spring-loaded means. The connecting block is mounted on a distal end portion of the telescopic shaft, and is formed with an external screw thread. The tool accessory has a coupling portion formed with a cavity for capping on the connecting block. The cavity is confined by an innermost end wall and an internally threaded surrounding wall for mounting threadedly on the connecting block. The spring-loaded means is mounted on the connecting block, extends into the cavity of the tool accessory, and abuts against the innermost end wall to provide an axial biasing force for biasing the coupling portion of the tool accessory away from the connecting block in order to enhance threaded engagement between the tool accessory and the connecting block.

SUMMARY OF THE INVENTION

The main object of this invention is to provide a multi-function telescopic hand tool with replaceable tool accessory for performing a number of functions and which includes a connecting member that is connected securely and releasably to the tool accessory.

Accordingly, a telescopic hand tool of the present invention includes a handle member, a hollow drive shaft, a telescopic shaft, a connecting member, a tool accessory and a tool bit. The drive shaft extends axially from the handle member, and has a distal bit-retaining end portion. The telescopic shaft is disposed within the drive shaft, and has a distal end section retractable into and extendible outwardly from the distal bit-retaining end portion of the drive shaft. The connecting member is mounted securely on the distal end section of the telescopic shaft so as to be retractable therewith into the drive shaft. The connecting member includes a tubular body having an external screw thread and an end face formed with a receiving hole, and a magnet disposed securely in the receiving hole. The tool accessory has a coupling portion formed with a cavity for capping on the connecting member. The cavity is confined by an internally threaded surrounding wall for connecting threadedly with the external screw thread of the connecting member. The tool bit is mounted on the distal bit-retaining end portion of the drive shaft after removal of the tool accessory from the connecting member and after the connecting member and the telescopic shaft are retracted into the drive shaft.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
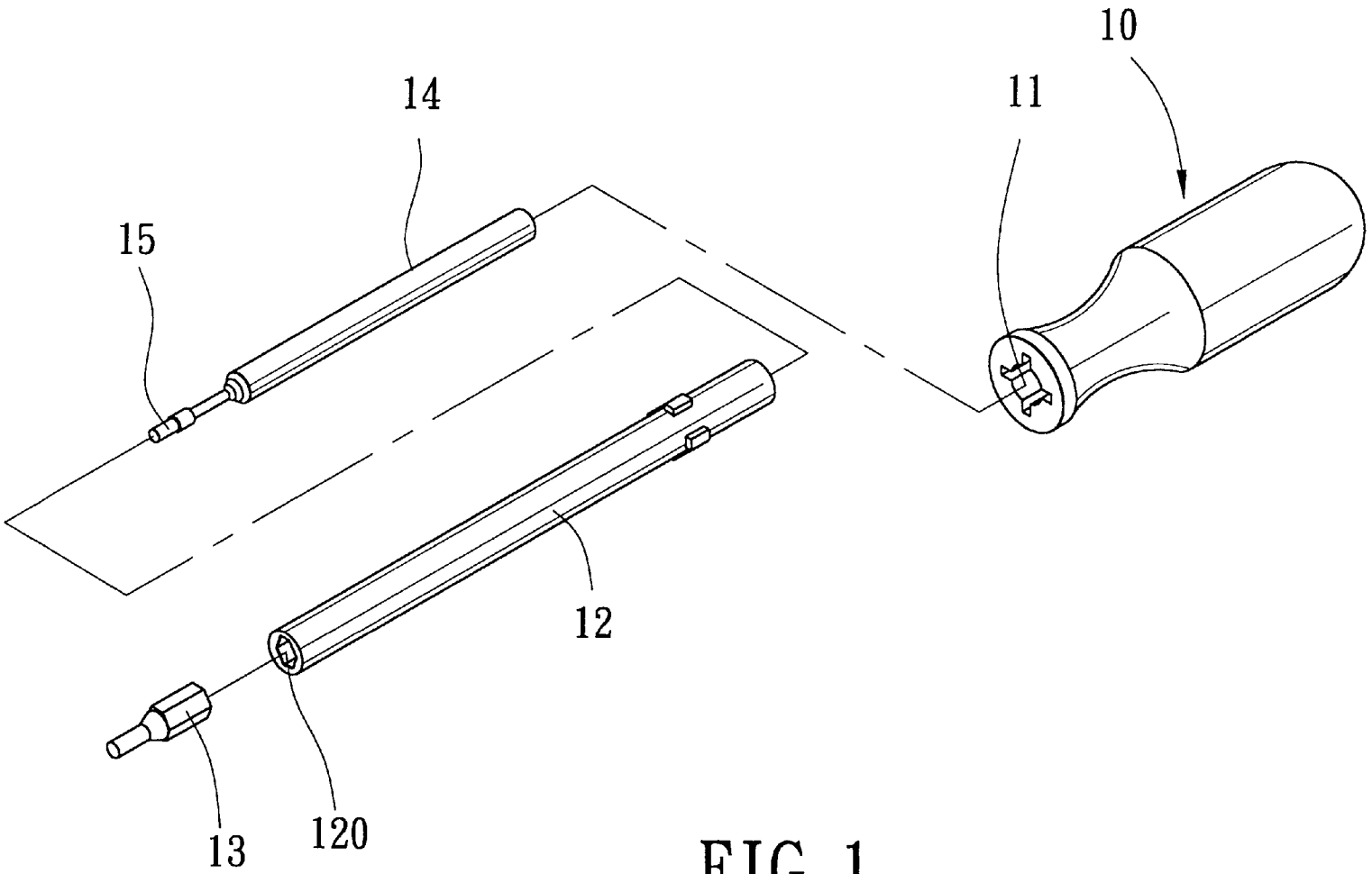
FIG. 1 PRIOR ART
FIG. 1 is an exploded view of a conventional telescopic hand tool.
Figure 2:
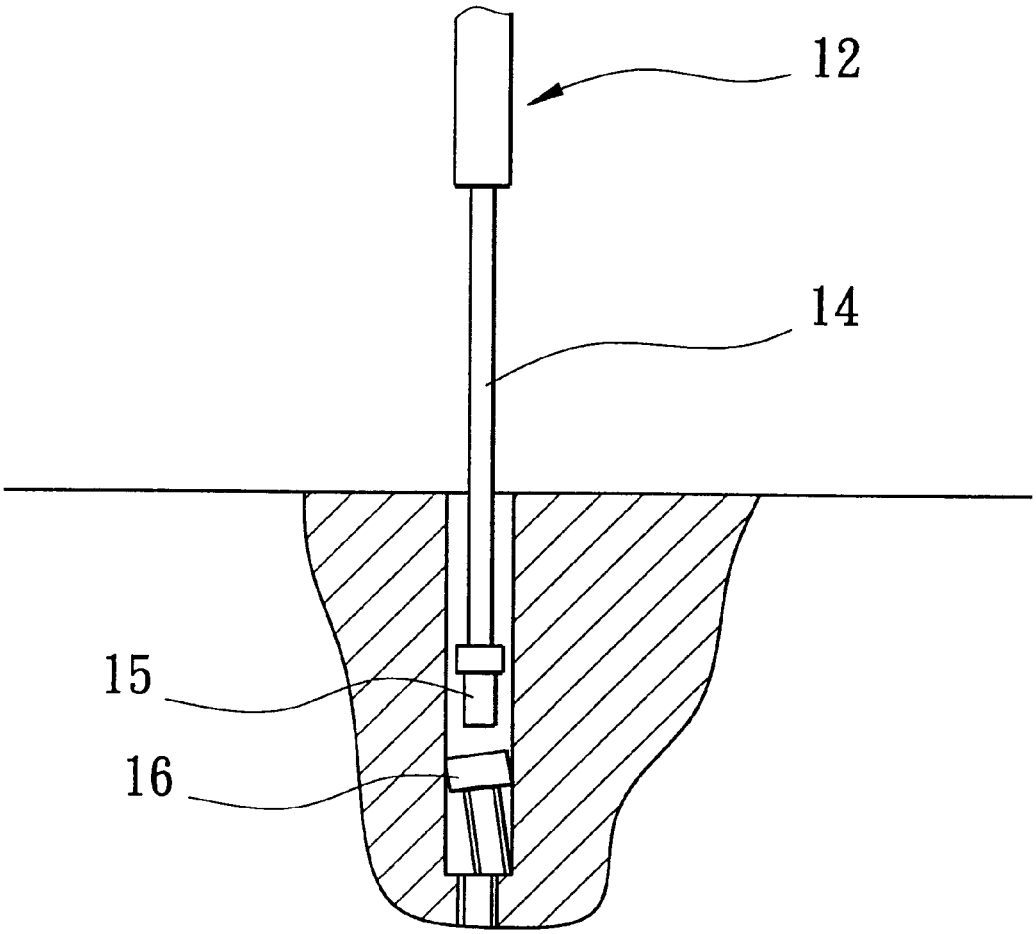
FIG. 2 PRIOR ART
FIG. 2 illustrates the conventional telescopic hand tool in use.
Figure 3:
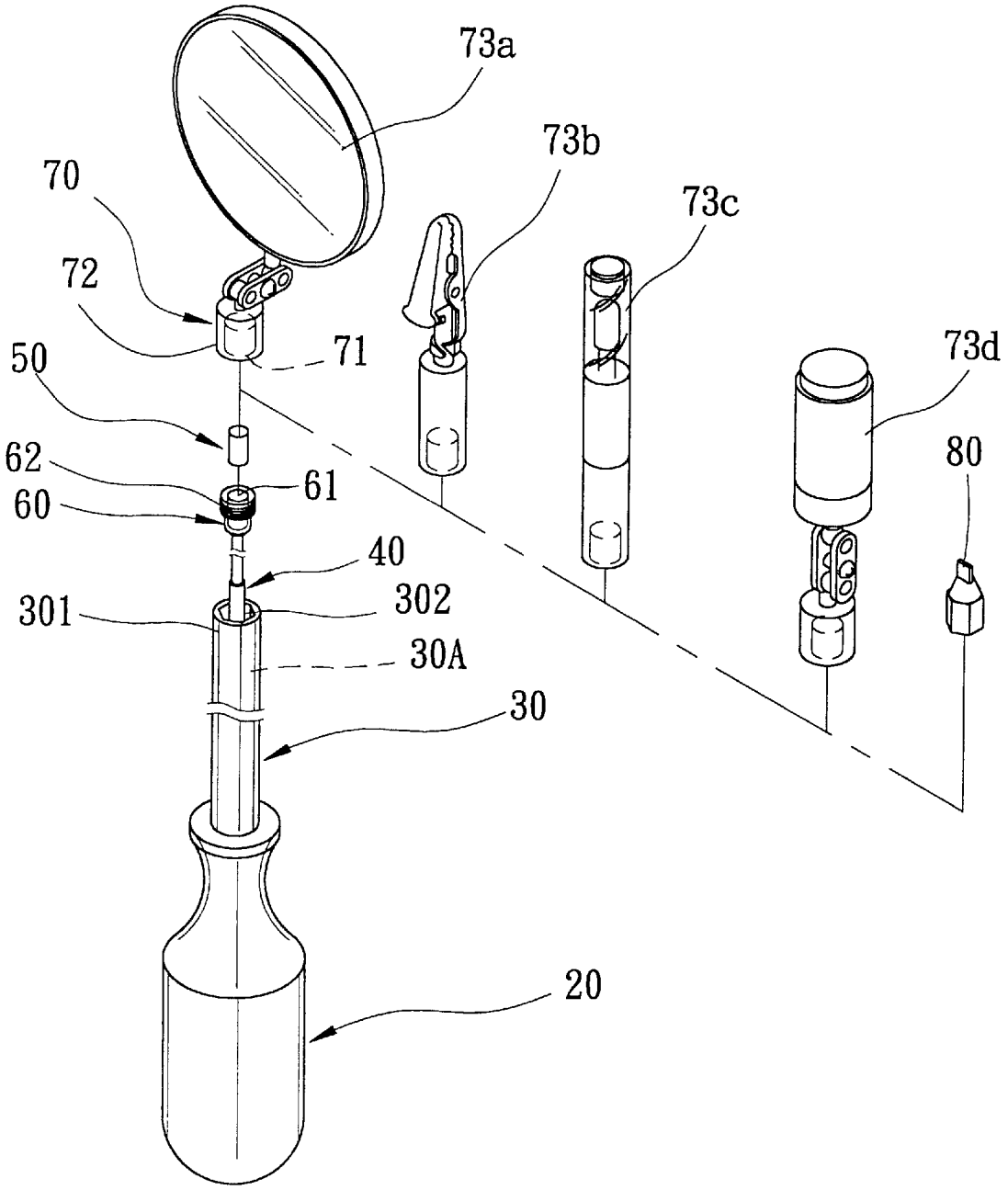
FIG. 3 is a partly exploded view of a telescopic hand tool of the present invention.
Figure 4:
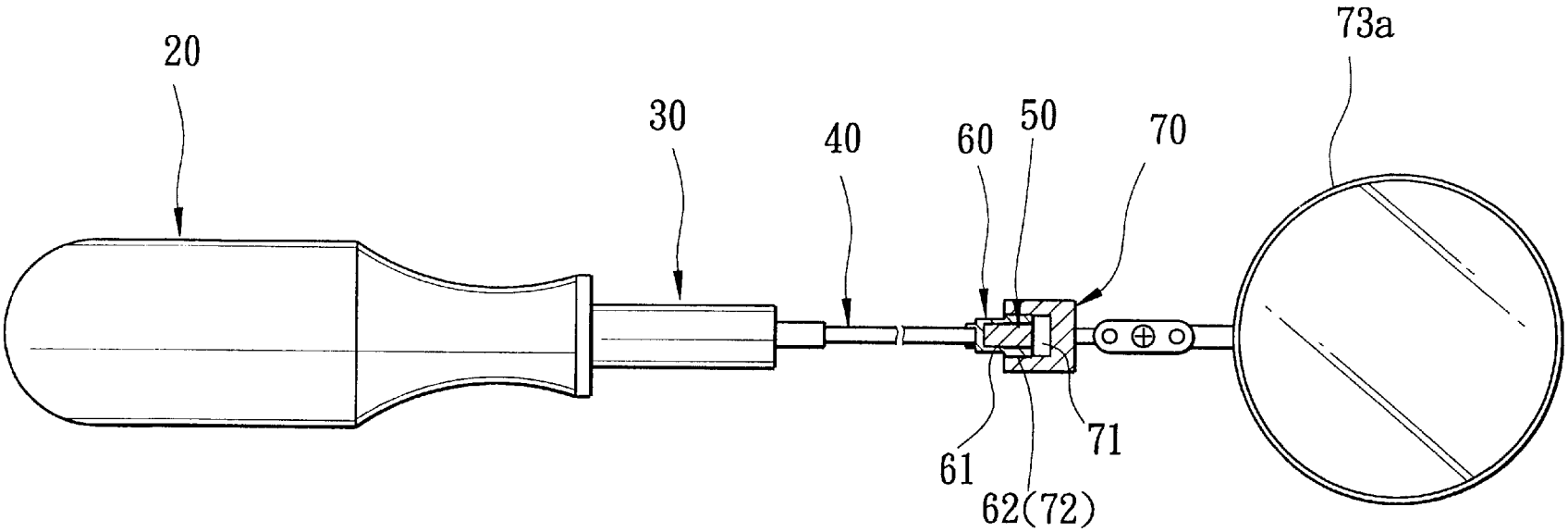
FIG. 4 is a schematic partly sectional view of the telescopic hand tool of the present invention in use.

Referring to FIGS. 3 and 4, the preferred embodiment of a telescopic hand tool of this invention is shown to include an elongated handle member 20, a hollow drive shaft 30, a telescopic shaft 40, a connecting member 60, a tool accessory 70, and a tool bit 80.

As illustrated, the drive shaft 30 confines an accommodating space (30A) therewithin, and extends axially from the handle member 20. The drive shaft 30 has a distal bit-retaining end portion 301 formed with an axially extending bit retaining hole 302 via which access into the accommodating space (30A) is possible. Preferably, the bit retaining hole 302 is confined by an internal polygonal wall.

The telescopic shaft 40 is disposed within the accommodating space (30A) of the drive shaft 30, and has a distal end section retractable into and extendible outwardly from the end portion 301 of the drive shaft 30 via the bit retaining hole 302.

The connecting member 60 is mounted securely on the distal end section of the telescopic shaft 40 so as to be retractable therewith into the distal accommodating space (30A) of the drive shaft 30. The connecting member 60 includes a tubular body which has an external screw thread 62 and an end face formed with an axially extending blind receiving hole 61, and a magnet 50 disposed securely in the hole 61.

The tool accessory 70 has a coupling portion 72 formed with a cavity 71 for capping on the connecting member 70. The cavity 71 is confined by an innermost end wall and an internally threaded surrounding wall 72 for connecting threadedly with the external screw thread 62 of the connecting member 70.

The tool bit 80 is mounted in the bit-retaining hole 302 after removal of the tool accessory 70 from the connecting member 70 and after the connecting member 60 and the telescopic shaft 40 are retracted fully into the accommodating space (30A) of the drive shaft 30. Preferably, the tool bit 80 is provided with a polygonal connecting portion for engaging the bit-retaining hole 302.

In the preferred embodiment, the tool accessory 70 includes a mirror (73*a*) mounted hingeably on the coupling portion 72. Alternatively, the tool accessory 70 may include a clip unit 73*b* mounted operably on the coupling portion or an illuminating device 73*c* mounted on the coupling portion to extend axially therefrom. The tool accessory 70 may also include a magnetic retriever 73*d* mounted hingeably on the coupling portion.

Upon removal of the tool accessory 70 from the telescopic shaft 14, the connecting member 60 can be pushed to retract into the distal bit-retaining end portion 301 of the drive shaft 30 by insertion of the tool bit 80 into the bit receiving hole 302. Thus, the telescopic hand tool of the present invention serves as a conventional screw driver.

With this invention thus explained, it is apparent that numerous modifications and variations can be made without departing from the scope and spirit of this invention. It is therefore intended that this invention be limited only as indicated in the appended claims.

I claim:

1. A telescopic hand tool, comprising:

a handle member;

a hollow drive shaft extending from said handle member, and having a distal bit-retaining end portion;

a telescopic shaft disposed within said drive shaft, and having a distal end section retractable into and extendible outwardly from said distal bit-retaining end portion of said drive shaft;

a connecting member mounted securely on said distal end section of said telescopic shaft so as to be retractable therewith into said drive shaft, said connecting member including a tubular body having an external screw thread and an end face formed with a receiving hole, and a magnet disposed securely in said receiving hole;

a tool accessory having a coupling portion formed with a cavity for capping on said connecting member, said cavity being confined by an internally threaded surrounding wall for connecting threadedly with said external screw thread of said connecting member; and a tool bit for mounting on said distal bit-retaining end portion of said drive shaft after removal of said tool accessory from said connecting member and said telescopic shaft are retracted into said drive shaft.

2. The telescopic hand tool as defined in claim 1, wherein said tool accessory includes a mirror mounted on said coupling portion.

3. The telescopic hand tool as defined in claim 1, wherein said tool accessory includes a clip unit mounted on said coupling portion.

4. The telescopic hand tool as defined in claim 1, wherein said tool accessory includes an illuminating device mounted on said coupling portion.

5. The telescopic hand tool as defined in claim 1, wherein said tool accessory includes a magnetic retriever mounted on said coupling portion.

* * * * *